United States Patent [19]

Yoshida et al.

[11] 4,257,317

[45] Mar. 24, 1981

[54] METHOD OF MANUFACTURING PAPER CONTAINERS

[75] Inventors: Tetsuo Yoshida; Toshiyuki Ogura; Shinji Tajiri; Toshio Sata, all of Fujinomiya, Japan

[73] Assignee: Fuji Photo Film Co., Ltd., Minami-ashigara, Japan

[21] Appl. No.: 27,701

[22] Filed: Apr. 6, 1979

[30] Foreign Application Priority Data

Apr. 17, 1978 [JP] Japan ..... 53/45062

[51] Int. Cl.[3] ..... B31B 7/14

[52] U.S. Cl. ..... 493/59; 493/63; 493/93

[58] Field of Search ..... 93/36 M, 49 M, 58 R, 93/40, 41, 41.1, 43, 54 R, 355 B, 8 W, 36.01; 53/492, 381 R, 381 A

[56] References Cited

U.S. PATENT DOCUMENTS

| | | | |
|---|---|---|---|
| 1,137,269 | 4/1915 | Kormanshaus | 93/36 M |
| 1,492,902 | 5/1924 | Smith | 93/40 X |
| 3,802,325 | 4/1974 | Bardenhagen et al. | 93/43 X |
| 3,910,168 | 10/1975 | Verreydt et al. | 93/43 X |

*Primary Examiner*—James F. Coan

*Attorney, Agent, or Firm*—Sughrue, Rothwell, Mion, Zinn and Macpeak

[57] ABSTRACT

A method of manufacturing a paper container, where a parallelepiped inner body in the form of a box having no top panel board from a first blank sheet of corrugated board or card board is first fashioned. An outer body by packaging the inner body with a second blank sheet in such a manner that said outer body is in close contact with the outside of the inner body is then made. Finally, a continuous cut in the outer body is made to divide the outer body into the upper part and the lower part so that said upper part of the outer body can be detachably mounted on the inner body.

6 Claims, 8 Drawing Figures

METHOD OF MANUFACTURING PAPER CONTAINERS

BACKGROUND OF THE INVENTION

This invention relates to a method of manufacturing a so-called "pill-box" shaped paper container which is of a dual construction comprising an inner body and an outer body, the container being separated into a container body and its cover.

Such a pill-box shaped paper container is provided for accommodating a material which should be intercepted from light or sealed completely. Typical is a container for photographic film. In general, the container body and the cover thereof are separately manufactured.

However, this manufacturing method is disadvantageous in that it requires a number of manufacturing steps and the work is relatively complicated. This results in an increase of the container manufacturing cost. Also, in such prior art containers there is play between the body and the cover of the container and therefore it is impossible to completely seal a material therein.

In order to eliminate the above-described drawbacks, a method of manufacturing a pill-box shaped paper container has been proposed by Japanese Patent Application Laid-Open No. 148383/1977 in which a box is formed by surrounding a preformed inner packaging body with an outer packaging body blank sheet having parallel perforation lines in the form of a belt in such a manner that the outer packaging body is in close contact with the outside of the inner packaging body. That is, in this prior art method, the container body and the cover are formed as one box, and when the box is used, the cover is formed by removing the belt-shaped perforated portion of the box. This method is improved in manufacturing cost and sealing efficiency compared with the above-described method in which the container body and the cover are separately manufactured.

However, the method proposed by the aforementioned Japanese Patent Application Laid-Open No. 148383/1977 is still disadvantageous in the following areas: It is necessary to provide at least a gap corresponding to the belt-shaped perforated part between the inner packaging body and the outer packaging body. If the panel board of a part of the box, which has the gap, namely, the top panel board is depressed inwardly, then it is readily curved. Accordingly, in the formation of the box, it is difficult to completely coat the top panel board with adhesive. Even if the top panel board is completely coated with adhesive, it is readily deformed if depressed during handling process such as conveying.

When the container manufacturing according to the method is used, it is necessary to peel the belt-shaped perforated part off the outer packaging body, and during this peeling operation the boundary portion between the container body and the cover may be torn. Thus, the container itself presents a problem as to its sealing characteristics.

SUMMARY OF THE INVENTION

Accordingly, an object of this invention is to provide a method of manufacturing at low manufacturing cost and on a large scale a pill-box shaped paper container in which the above-described drawbacks accompanying prior art methods have been eliminated.

It is another object of this invention to provide a method of manufacturing containers which are excellent in rigidty and sealing characteristics and can be readily handled.

The foregoing objects of the invention has been achieved by the provision of a method of manufacturing a pill-box shaped paper container in which, according to the invention, a parallelepiped inner body is made in the form of a box having no top panel board of a first blank sheet and an outer body is made by packaging the inner body with a second blank sheet in such a manner that the outer body is in close contact with the outside of the inner body. A continuous cut is provided in the outer body to divide the outer body into the upper part and the lower part, so that the upper part of the outer body can be detachably mounted on the inner body.

This invention will be described with respect to the drawings and the description of the preferred embodiment that follow.

DESCRIPTION OF THE PREFERRED EMBODIMENT

This invention will now be described with reference to its preferred embodiment in detail.

Figure 1:
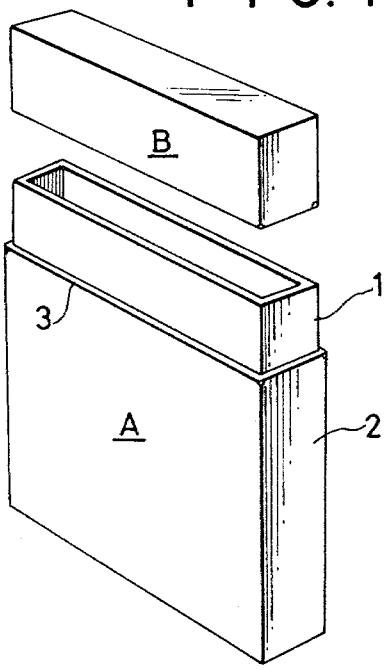
FIG. 1 is a perspective view showing the appearance of a pill-box shaped paper container manufactured according to this invention.

FIG. 1 is a perspective view showing a relatively flat, rectangular pill-box shaped container made of paper according to a method of the invention. For convenience in description, a container body A and a cover B removed from the body A will be the designations used in describing these components.

In FIG. 1, reference numeral 1 designates an inner body having no top panel board, and reference numeral 2 designates an outer body provided in close contact with the outside of the inner body 1. The inner and outer bodies 1 and 2 are assembled to form the container body A, and the cover B is detachably mounted on the container body A. This cover B is obtained by cutting the outer body 2 provided in the form of a box on the outside of the inner body 1 along a cutting line 3 into respective upper and lower parts. This will become more apparent from the following description.

Figure 2:
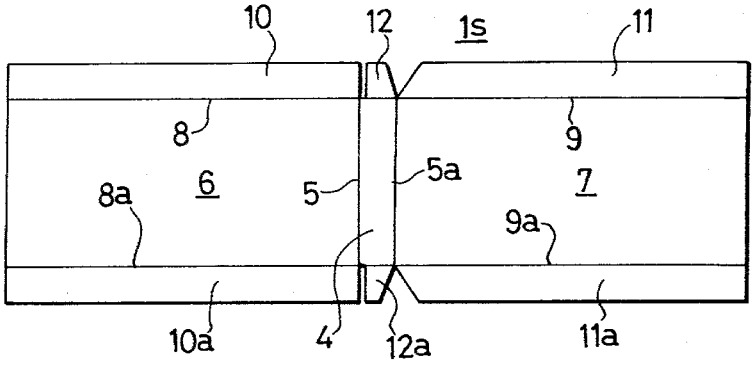
FIG. 2 is an unfolded view showing an inner body blank sheet employed in the invention.

FIG. 2 is an unfolded view of a blank sheet 1*s* forming the inner body 1. The blank sheet 1*s* is a relatively thick corrugated board or card board (a corrugated board approximately 2 mm in thickness being often used; however, the thickness may be of the order of 0.5 mm if it is rigid and strong). A front panel board 6 and a rear panel board 7 are provided through scoring lines 5 and 5*a* on both sides of a bottom panel board 4, respectively. Side panel boards 10 and 10*a* are provided through scoring lines 8 and 8*a* on both sides of the front panel board 6, respectively. Similarly, side panel boards 11 and 11*a* are provided through scoring lines 9 and 9*a* on both sides of the rear panel board 7, respectively. Furthermore, folding flaps 12 and 12*a* are provided on both confronting sides of the bottom panel board 4 between the score lines 5 and 5*a*.

Figure 3:
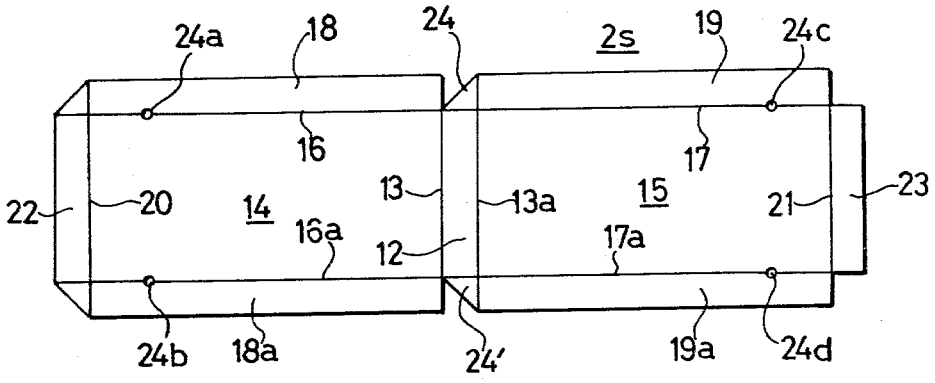
FIG. 3 is an unfolded view showing an outer body blank sheet employed in the invention.

FIG. 3 is an unfolded view of a blank sheet 2*s* forming the outer packaging body 2. The blank sheet 2*s* used to package the inner body 1 and made in the form of a box of the blank sheet 2*s* in such a manner that it is in close contact with the outside of the inner body 1. The material of the blank sheet 2*s* is the same as that of the blank sheet 1*s*. The blank sheet 2*s* has a front panel board 14 and a rear panel board 15 provided through scoring lines 13 and 13*a* on both sides of a bottom panel board 12, respectively. Side panel boards 18 and 18*a* are provided through scoring lines 16 and 16*a* on both sides of the front panel board 14, respectively. Similarly, side panel boards 19 and 19*a* are provided through scoring lines 17 and 17*a* on both sides of the rear panel board 15, respectively. Furthermore, flaps 24 and 24' are provided through scoring lines on both confronting sides of the bottom panel board 12 between the score lines 13 and 13*a*. It should be noted that there are four small holes (usually about 1 to 2 mm in diameter) 24*a*, 24*b*, 24*c* and 24*d* on the scoring lines 16, 16*a*, 17 and 17*a* of the front panel board 14 and the rear panel board 15. These holes are utilized to permit a cutting edge to correctly cut the outer packaging body 2 along the cutting line 3, as will become more apparent later. End flaps 22 and 23 are also provided to form the top panel.

The size of the blank sheet 2*s* is such that it will form a box by packaging the inner body 1 made in the form of a box of the blank sheet 1*s*.

The procedure of manufacturing the pill-box shaped paper container by utilizing the above-described blank sheets 1*s* and 2*s*, will now be described.

Figure 4:
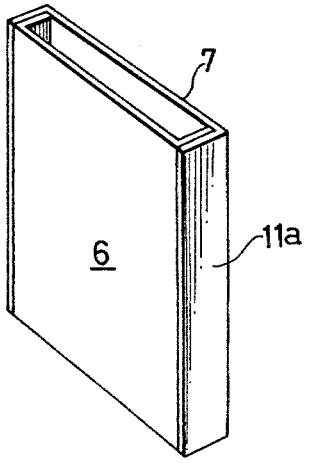
FIG. 4 is a perspective view showing the inner body in the form of a box.

(Step 1) The blank sheets 1*s* are taken out of a sheet stock (not shown) one after another. Then, the blank sheet 1*s* is folded along the scoring lines which have been treated to facilitate the folding the blank sheet, in such a manner that the front panel board and the rear panel board are upright on the bottom panel board 4. In this process of keeping the two panel boards in the upright positions (hereinafter referred to as "an erecting process" when applicable) (or in the preceding process), the side panel boards 11 and 11*a* and the flaps 12 and 12*a* are applied with adhesive, and are pushed toward the side panel boards 10 and 10*a* to thereby box the inner body 1 having no top panel board as shown in FIG. 4. This boxing work will not be described in detail, because it is carried out with a boxing machine well known in the art.

In the erecting process of the blank sheet 1*s*, if necessary, so-called wrapround packaging is carried out in which a material to be packaged is packaged thereby simultaneously.

Figure 5:
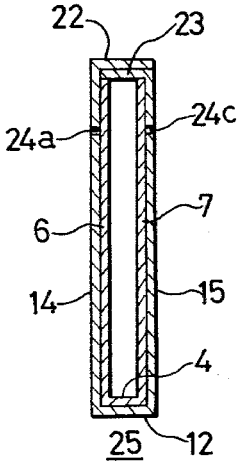
FIG. 5 is a sectional side view of a box obtained by packaging the inner body with the outer body.

(Step 2.) The inner packaging body 1 boxed in the above-described process (Step 1.) is placed on the blank sheet 2*s*. Among the inner surfaces (surrounding the inner packaging body 1) of the blank sheet 2*s*, the portions which are brought into contact with the inner packaging body 1 when the sheet 2*s* is formed into a box (except for the top end portions including the small holes 24*a*, 4*b*, 24*c* and 24*d* ) have been applied with adhesive. Similarly as in the above-described process (Step 1), during the erecting process of the blank sheet 2*s* the inner packaging body 1 is completely sealed by the blank sheet 2*s*. AS a result a dual box 25 comprising the inner packaging body 1 and the outer packaging body 2 is formed as shown in the sectional view of FIG. 5.

(Step 3) The dual box 25 thus formed is transferred to a cutting process where it is cut into the container body A and the cover B.

Figure 6:
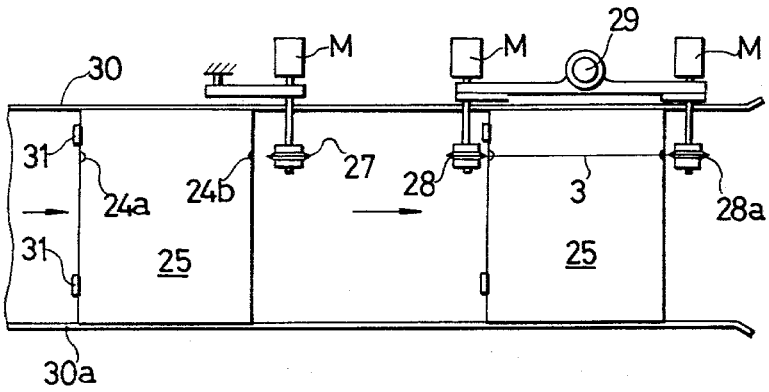
FIG. 6 is a plan view showing a machine adapted to cut the outer body.
Figure 7:
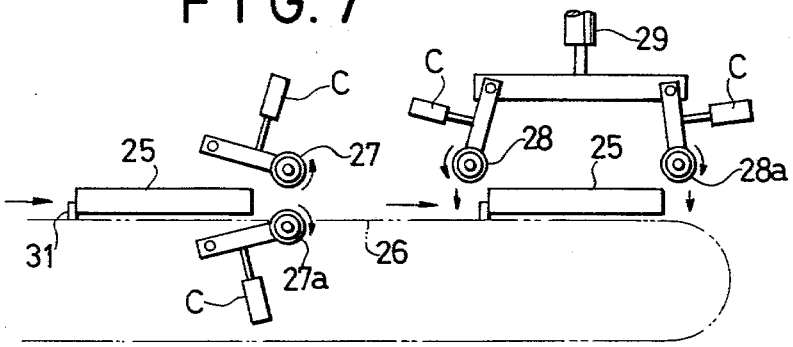
FIG. 7 is a side view showing the machine in FIG. 6.

FIG. 6 is a plan view showing a cutting machine which will cut the dual box 25, and FIG. 7 is a side view showing the cutting machine.

An illustrated in FIGS. 6 and 7, the cutting machine has cutting edges 27 and 27*a* provided respectively on the front panel board side and the rear panel board side of the dual box 25 which is conveyed in flat state by a conveying means such as a conveyer 26. Cutting edges 28 and 28*a* are provided at the next station, which is at a position advanced in the movement direction of the conveyer, in such a manner the cutting edges 28 and 28*a* are respectively on the two side panel boards of the box 25. The cutting edges 27, 27*a*, 28 and 28*a* are driven by different electric motors M to rotate in the directions of the arrows in FIG. 7, respectively. Furthermore, the cutting edges are energized to abut against the box 25 under predetermined pressures by energizing means such as cylinders C, respectively. In addition, the cutting edges 28 and 28*a* are designed so that they are moved up and down by means of an operating devices 29.

The box 25 is guided by a pair of guides 30 and 30*a* which are provided respectively along the top panel board and the bottom panel board thereof and it is intermittently conveyed by pawls 31 provided on the conveyor 26. The pawls act to push the box along the conveyer. The cutting edges 27 and 27*a* are set so that their edges are on the lines connecting the small holes 24*a* and 24*b* and the small holes 24*c* and 24*d*, respectively, which have been formed at the corners of the box 25 before. Similarly, the cutting edges 28 and 28*a* are set so that their edges are on the lines connecting the small holes 24*a* and 24*c* and the small holes 24*b* and 24*d*, respectively. Rotatable round edges or stationary knife edges can be employed as the cutting edges 27, 27*a*, 28 and 28*a*. In either case, the edge height is set to a value somewhat larger than the thickness of the board of the outer packaging body 2.

Naturally, since the side panel boards 18 and 18*a* and the side panel boards 19 and 19*a* of the outer packaging body 2 overlap one on another, the board thickness is doubled as much, and accordingly the edge height of each of the cutting edges 28 and 28*a* is set to a value correspondingly larger.

While the box 25 being conveyed by the conveyer 26 through the cutting machine cuts 3 (FIG. 1) are first formed on the front panel board is 14 and the rear panel board of the outer packaging body 2 by the cutting edges 27 and 27*a*, respectively. When the box 25 is thereafter conveyed to the predetermined cutting position, the operating device 29 is driven to move the rotating cutting edges 28 and 28*a* downward to provide the cuts 3 on the side panel boards 18 and 18*a* and 19 and 19*a* of the outer packaging body 2. Thereafter, the cutting edges 28 and 28*a* are moved upward, and the box 25 is further conveyed to be removed from the conveyer 26.

When the panel boards of the outer packaging body 2 are cut by the cutting edges, the panel boards are curved inwardly by being depressed by the cutting edges. However, the panel boards are positively cut because the edges of the cutting edges are energized towards the respective panel boards under the predetermined pressure and the edge heights correspond to the respective board thicknesses. In this connection, since the small holes 24*a*, 24*b*, 24*c* and 24*d* are provided in the outer packaging body 2 as described before, the cut lines on the front panel boards and the rear panel boards made by the cutting edges 27 and 27*a* and the cut lines on the side panel boards made by the cutting edges 28 and 28*a* are aligned with one another, that is, they are never shifted from one another.

Passing through the above-described process steps 1–3, the box 25 is formed into the relatively flat, rectangular pill-box shaped paper container as shown in FIG. 1.

The paper container manufacturing according to this method is of a dual construction in which the inner packaging body 2 is completely in close contact with the outer packaging body 3. Therefore, the container is strong and rigid. The container body A is separated from the cover B by one thin cut. Accordingly, although the cover can be readily opened, the inside of the container is protected from light and is completely sealed when the cover is placed on the container body. Furthermore, since the above-described steps 1–3 can be achieved on one manufacturing line, troublesome process control can be eliminated, and the containers can be manufactured on a large scale. Thus, the invention offers a number of improvements over the prior art.

The invention has been described with its preferred embodiment; however, it should be noted that the invention is not limited thereto to thereby. The invention can be variously modified. In the above-described embodiment, the small circular holes 24*a*, 24*b*, 24*c* and 24*d* are formed in the blank sheets 2*s*; however, the configuration of each small hole is not limited to a circle. The provision of the small holes is not always necessary in the case where it is possible to correctly set the cutting edges at the predetermined positions with respect to the outer packaging body 2.

It is not always necessary that the cut lines on the outer packaging body 2 be straight. That is, they may be curves, if necessary (or according to the necessity in design).

In the above-described embodiment, the cover B is formed after the box has been formed by completely sealingly packaging the inner packaging body 1 with the outer packaging body 2. However, the same effect can be obtained even by forming the cover with the top panel boards 22 and 23 of the outer packaging body 2 opened.

Figure 8:
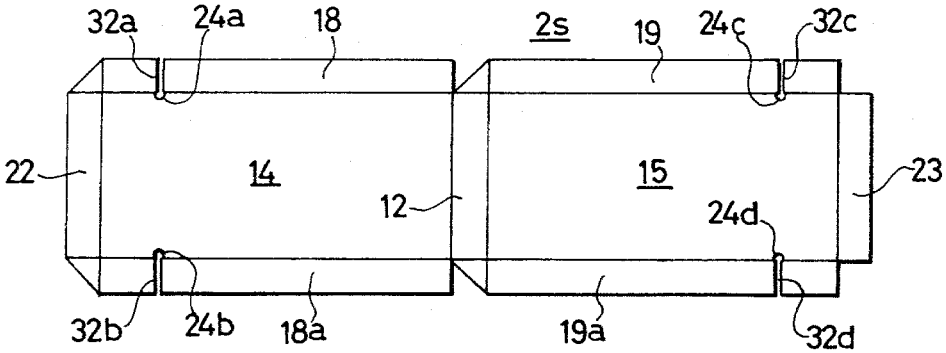
FIG. 8 is an unfolded view showing a second example of the outer body blank sheet.

If as shown in FIG. 8 cuts 32*a*, 32*b*, 32*c* and 32*d* connecting respectively small holes 32*a*, 32*b*, 32*c* and 32*d* are provided in the side panel boards 18, 18*a*, 19 and 19*a* of the blank sheet 2*s* before the outer packaging body 2 is subjected to cutting and separation, then, the number of processes of cutting the side panel boards of the outer packaging body 2 can be reduced.

As is apparent from the above description, according to the invention, the pill-box shaped paper containers formed are rigid and excellent in sealing characteristic and are readily handled and can be manufactured on a large scale.

What is claimed is:

1. A method of manufacturing a shaped paper container, comprising the steps of:

forming a parallelepiped inner body in the form of a box having no top panel from a single first blank sheet of corrugated board or card board, forming an outer body by packaging said inner body within a single second blank sheet in such a manner that said outer body is in close contact with the outside of said inner body, and providing a continuous cut in said outer packaging body to divide said outer packaging body into an upper part and a lower part so that said upper part of said outer packaging body can be detachably mounted on said inner packaging body.

2. A method as in claim 1, further comprising the step of providing holes at cutting positions on folding lines on said second blank sheet forming said outer body, said folding lines defining corners of said outer body when it is formed from said second blank sheet, whereby cuts formed in said outer packaging body are not shifted relative to one another.

3. The method as in claim 2 wherein the step of cutting comprises positioning a cutting element at one hole on the edge of outer body and cutting to another of said holes.

4. The method as in claims 1, 2, or 3 wherein the first blank sheet includes portions defining front and rear flaps together with side flaps separated by score lines and the step of forming an inner body comprises the steps of folding front and rear flaps about score lines to a position parallel to each other and inwardly folding side flaps attached to each of said front and rear flaps into an overlapping relationship to form side walls of said paralleopiped.

5. The method as in claim 4 further comprising the step of gluing tabs formed from said first blank sheet to said side walls.

6. The method as in claims 1, 2 or 3 wherein the step of forming an outer body comprises the steps of folding front and rear flaps about score lines to a position parallel to each other, inwardly folding side flaps attached to each of said front and rear flaps into an overlapping relationship to form side walls and forming a top panel for said container by folding a top flap over the top of said container.

* * * * *